US006867676B1

(12) United States Patent
Chung

(10) Patent No.: US 6,867,676 B1
(45) Date of Patent: Mar. 15, 2005

(54) TRANSFORMER

(76) Inventor: Yu-Lin Chung, No. 4, Lane 130, Nan-Kang Rd, Sec. 3, Taipei (TW)

( * ) Notice: Subject to any disclaimer, the term of this patent is extended or adjusted under 35 U.S.C. 154(b) by 0 days.

(21) Appl. No.: 10/838,772

(22) Filed: May 3, 2004

(51) Int. Cl.[7] ..... H01F 27/30

(52) U.S. Cl. ..... 336/198; 336/210; 336/221; 336/200

(58) Field of Search ..... 336/65, 83, 90, 336/192, 198, 200, 210, 213, 221, 233–234

(56) References Cited

U.S. PATENT DOCUMENTS 6,320,492 B1 * 11/2001 Kubomura et al. ..... 336/213
6,362,715 B1 * 3/2002 Chiang et al. ..... 336/198
6,404,320 B1 * 6/2002 Yeh et al. ..... 336/200
6,483,411 B2 * 11/2002 Chiang et al. ..... 336/182

* cited by examiner

*Primary Examiner*—Tuyen T. Nguyen
(74) *Attorney, Agent, or Firm*—Pro-Techtor Inter-National Services

(57) ABSTRACT

The present invention is a kind of a transformer, equipped with a wire-winding flute on a wire-winding unit that has surrounding grooves added to each end, and adding plug pins to the for sides of a iron slot of a iron core, using the plug pins to attach itself to the inside of the grooves, for fast and close fixture of the wire-winding unit to the iron core, allowing the wire-winding unit to be not easily loosened, and also avoids collision leading to breakage of with the copper wires, thus increasing the tension resistance of the transformer, also increasing the surface distance between the high-pressure area and the iron core, to preventing short circuit.

1 Claim, 3 Drawing Sheets

TRANSFORMER

BACKGROUND OF THE INVENTION (a) Field of the Invention

The present invention is a small transformer easy to assemble and fix. In addition to avoiding damage to the copper wires due to collision, it can also improve pressure endurance ability and prevent short circuits.

(b) Description of the Prior Art

The small transformer is conventionally used in computer equipment, as shown in FIG. 7. A plurality of connecting terminals 300 made through high frequency wave or mould injection are established on both ends of a wire-winding unit 100 and a plurality of wire-winding flutes 101, vertically aligned amid the wire-winding unit 100, allowing the copper wires 400 to be wounded repeatedly therein. After the copper wires 400 are wound around the wire-winding unit 100, it is then disposed in an open slot 201 of an iron core 200.

For above-mentioned transformer, the wire-winding unit 100 that is in the open slot 201 of the iron core 200, does not have assembling structure, thereby causing loosening of the wire-winding unit thus colliding and damaging the copper wires 400. Some distributors wrap a transparent film around the wire-winding unit 100 after the copper wires 400 have been wound, then are fixed to the open slot 201 of the iron core 200, thereby enhancing cohesion. As a result, this causes the tension resistance to decrease, and causing short circuit, due to the reduction of distance between the transformer's high-pressure end and the surface of iron core 200.

SUMMARY OF THE INVENTION

The primary objective of the present invention is to equip a wire-winding unit with grooves and a corresponding iron core with plug pins, thereby allowing quick and tight insertion with the grooves, and will not loosen the wire-winding unit or cause the copper wire to break, resulting better tension resistance and also prevent short circuits.

DETAILED DESCRIPTION OF THE PREFERRED EMBODIMENTS

As shown in FIG. 1 to FIG. 6, a plurality of terminals 11 made through high frequency wave or mould injection at both ends of a wire-winding unit 1 of the small transformer as defined in the present invention. A plurality of wire-winding flutes 12 being arrayed vertically amid the wire-winding unit 1, allowing the copper wires 400 to be wounded repeatedly therein. The wire-winding unit 1 can be placed in a open slot 21 of an iron core 2, the feature of the present invention:

As shown in FIG. 4, at least two grooves 13 on either end of the wire-winding flutes 12 respectively amid the wire-winding unit 1. As shown in FIG. 3 and FIG. 5, a plug pin 22 is installed respectively at each of the four diagonal corners formed on the open slot 21 amid the iron core 2. The plug pins 22 can be respectively plugged into the grooves 13 of the wire-winding flutes 12 in order to tightly connect and position the wire-winding unit 1 and the iron core 2 (FIG. 1, FIG. 6).

The present invention is a design with the plug pins 22 inserted and positioned into grooves 13 to facilitate easy connection and assembly of the iron core 2 to the wire-winding unit 1 therein. The wire-winding unit 1 is not easy to loosen once positioned which will not collide with the wound copper wires, to prevent from breaking consequently. The wire-winding unit 1, after winding up with the copper wires 400, can tightly connect with the iron core 2 without the need of being wrapped with a layer of transparent film. Therefore the present invention is able to improve tension capability and can increase the distance between the high-pressure end of transformer and the surface of iron core 2 without causing short circuits.

A magnetism insulating plate (like nickel, zinc plate etc.) can be placed at the back of the iron core 2 to prevent electromagnetic interference (EMI).

In conclusion, the present invention has grooves implemented on either ends of the wire-winding flute, thereby connecting with the four corners of the iron core. Besides easy assembly, there is no loose unit or collision with the copper wires, thereby improving tension capability and preventing short circuits.

Figure 1:
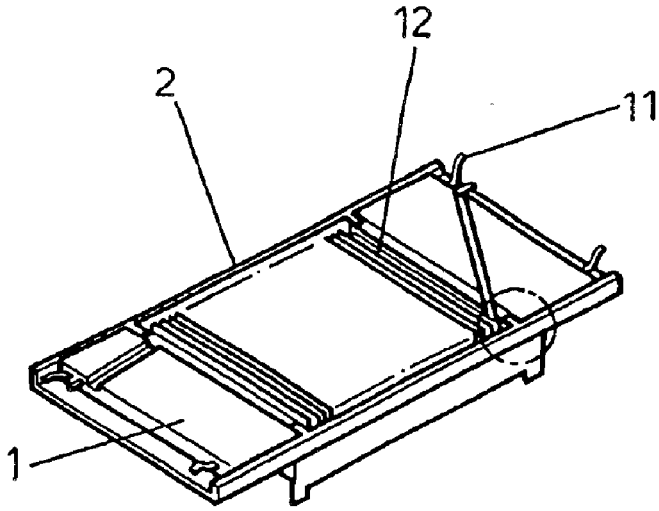
FIG. 1: shows a perspective view in accordance to the invention.
Figure 2:
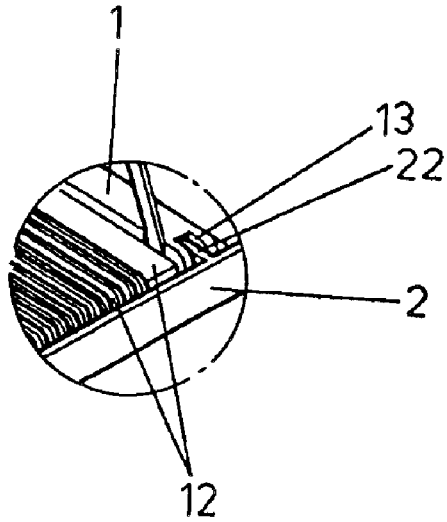
FIG. 2: shows a partially enlarged view according to the invention.
Figure 3:
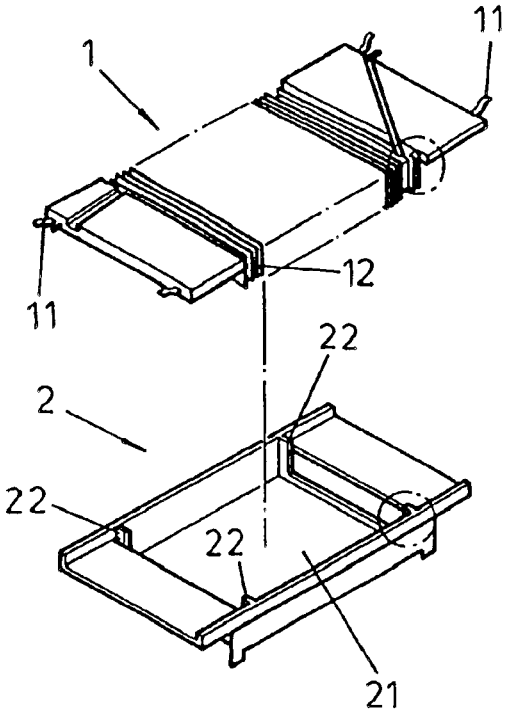
FIG. 3: shows an exploded view according to the invention.
Figure 4:
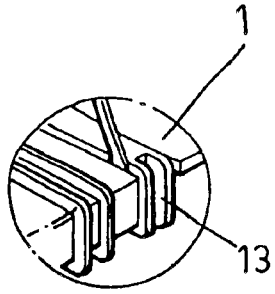
FIG. 4: shows a partially enlarged view of wire-winding unit according to the invention.
Figure 5:
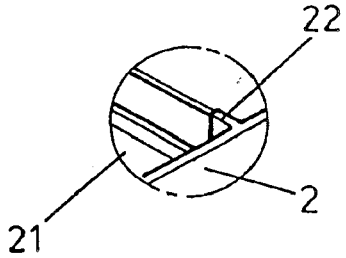
FIG. 5: shows a partially enlarged view of the iron core according to the invention.
Figure 6:
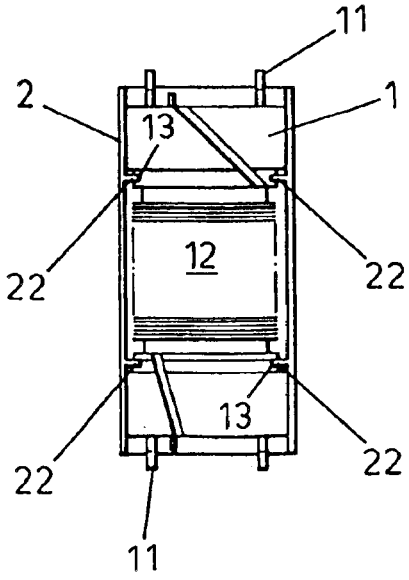
FIG. 6: shows a top plan view according to the invention.
Figure 7:
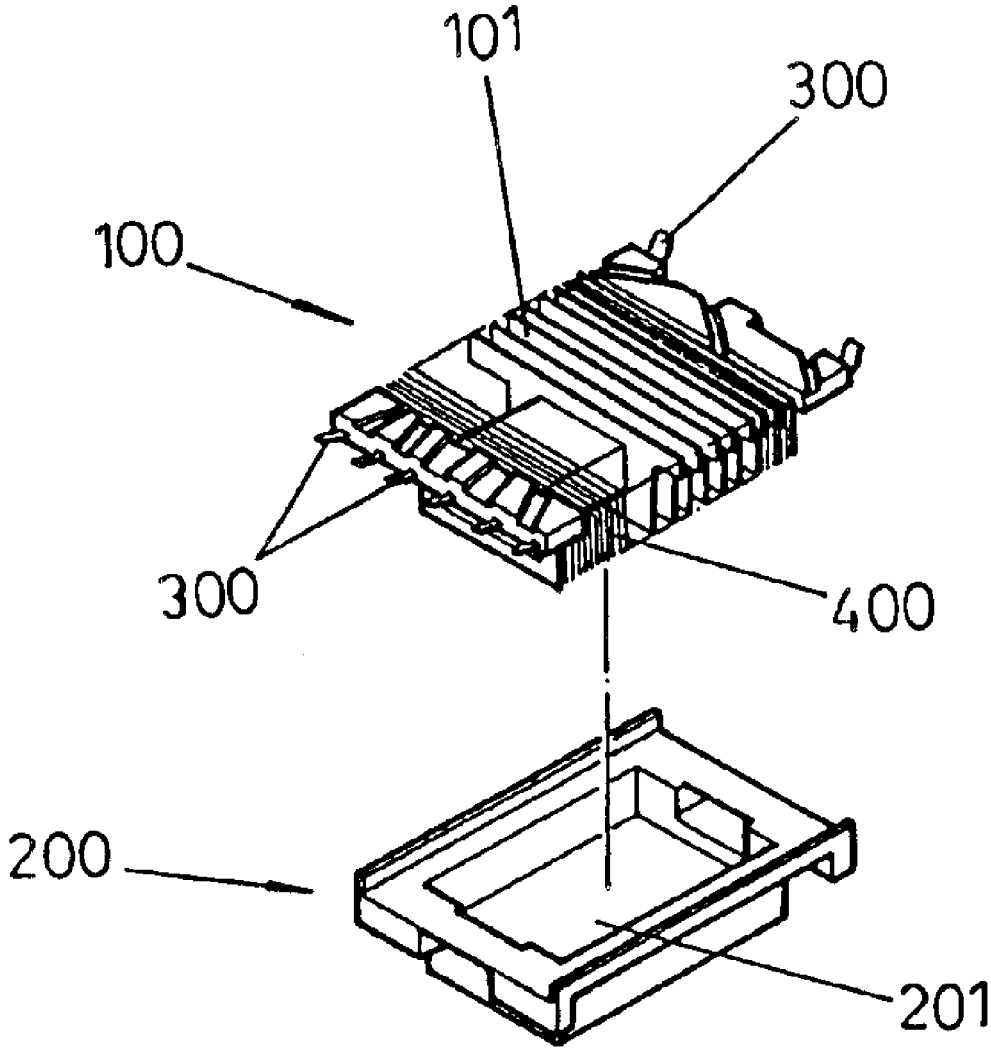
FIG.7 (PRIOR ART)
FIG. 7: shows an exploded view according to the prior art.

What is claimed is:

1. A transformer having terminals formed on both ends of a wire-winding unit comprising:

a plurality of wire-winding flutes vertically arrayed amid the surface of the wire-winding unit has copper wires encircled around, whereas an iron core has an iron slot, thereby allowing the wire-winding unit to be inserted; is characterized in that:

the wire-winding flutes having a plurality of grooves formed respectively on both ends of the wire-winding unit and a plug pin is disposed at each of the four corners of the open slot within the iron core; by inserting the plug pins in the grooves of the wire-winding unit thereby assembling the wire-winding unit and the iron core.

* * * * *